United States Patent [19]

Wood

[11] Patent Number: 4,743,022

[45] Date of Patent: May 10, 1988

[54] 2ND CHANCE POKER METHOD

[76] Inventor: Michael W. Wood, 1106 Willow Brook Ave., Denham Springs, La. 70726

[21] Appl. No.: 837,041

[22] Filed: Mar. 6, 1986

[51] Int. Cl.[4] ..... A63F 1/00

[52] U.S. Cl. ..... 273/85 CP; 273/85 G

[58] Field of Search ..... 273/85 G, 85 GP, 292, 273/149 R, 149 P, 38 A

[56] References Cited

U.S. PATENT DOCUMENTS

| | | | |
|---|---|---|---|
| 3,796,433 | 3/1974 | Fraley et al. | 273/85 CP |
| 3,876,208 | 4/1975 | Wachtler et al. | 273/85 CP |
| 4,614,342 | 9/1986 | Takashima | 273/85 CP |

OTHER PUBLICATIONS

Scarne, J. *Scarne's Encyclopedia of Games,* ©1973, p. 39.

*Primary Examiner*—Maryann Lastova

*Attorney, Agent, or Firm*—William David Kiesel

[57] ABSTRACT

An improved method of playing a casino-type poker game which can be played as either a table game or computer video game is disclosed wherein a player, by making an additional wager, can draw a sixth card so as to make the best poker hand from the six cards, provided the sixth card could possibly result in the player's obtaining a straight or better; and further, wherein the amount of the payback on the second wager varies depending upon the first five cards.

6 Claims, 1 Drawing Sheet

2ND CHANCE POKER METHOD

BACKGROUND OF THE INVENTION

1. Field of the Invention

This invention relates to a method for playing a casino-type game, and more particularly to a poker-type game that can be played as either a table game or a computer video game.

2. Prior Art

Card games have for centuries been a form of entertainment as well as wagering. However, in casino establishments, particularly in the United States, a wagering game cannot be played unless it meets all of the commercial criteria of the casino and the regulatory criteria established by the state or other governing authority. These criteria would include the following: (1) the game must be entertaining to play and have an ability to attract certain amounts of wagers during predetermined time periods, (2) the game must appear to have reasonable odds in favor of the player, but (3) the game must actually have unvarying overall odds in favor of the casino or dealer yet these odds cannot in many cases exceed certain limits, and (4) the game must be designed to be simple and easily monitored by non-players and the dealer to avoid errors and cheating. All of these factors have made it extremely difficult to obtain the necessary approvals for playing a new game in a casino.

There are many variations of poker. The most relevant known prior art game is Second Draw poker and a slight variation thereof called Second Chance poker. Second Draw is played like the typical casino stud poker game except that after a player has been dealt five cards, he is given an option to discard one card and draw a sixth card in an attempt to improve his hand. In this game, no second wager or change in odds is permitted. "Second Chance" poker is similar except that the player is given an opportunity to discard his entire first hand and draw a second hand. Again, no second wager is permitted, but the odds drop a constant amount if a second hand is elected.

To the applicant's knowledge, Second Draw and Second Chance have not been licensed for play in casinos. While the above mentioned games have appeared in computer video game format, their appeal has been diminished by the lack of random generation of cards.

While these earlier stud poker games have appealed to players, there has been for some time a strong desire by the casino industry to be able to provide a draw poker type game which offers the wagerer more options and which encourages additional betting, as well as meets all other governing authority, particularly one which can be computer played.

SUMMARY OF THE INVENTION

Therefore it is an object of this invention to provide a method of playing a draw poker type game which meets all of the criteria of casinos and regulatory agencies.

Another object of this invention is to provide a method of playing a draw poker type game on a computer and its video terminal which meets all of the criteria of casinos and regulatory agencies.

These and other objects and advantages of this invention shall become apparent from the ensuing descriptions of the invention.

Accordingly, a casino-type, draw poker game is described wherein the player makes a first wager and receives five cards, then may discard up to five cards and receive five new cards to form a second hand, the second hand being compared to a posted, fixed, hand ranking to determine if the player has lost his first wager or if the player has won in an amount varied by posted odds correlated to the fixed, hand ranking. This comparison is achieved by comparing the first or second hand to an odds chart to determine if the player has lost or won an amount based on the first wager. The player is then allowed to place a second wager entitling the player to draw a sixth card to form a third hand consisting of any of the five cards in the second hand plus the sixth card, provided the sixth card would create the possibility of the third hand's achieving a ranking of a straight or higher, and also provided that, if the second hand had a ranking of straight or higher, the sixth card must create the possibility of the third hand's achieving a still higher ranking, dealing the sixth card to the player, and determining if the player lost his second wager or if the player has won an amount varied by a second set of posted odds.

Again, the comparison of the third hand is accomplished using the odds chart to determine if the player has lost or won an amount based on the second wager. This odds chart comprises data which determines whether or not a player wins or looses and, if the player wins, the odds for winning. In that odds may vary, the odds chart may vary.

BRIEF DESCRIPTION OF THE APPENDIX

Figure 1:
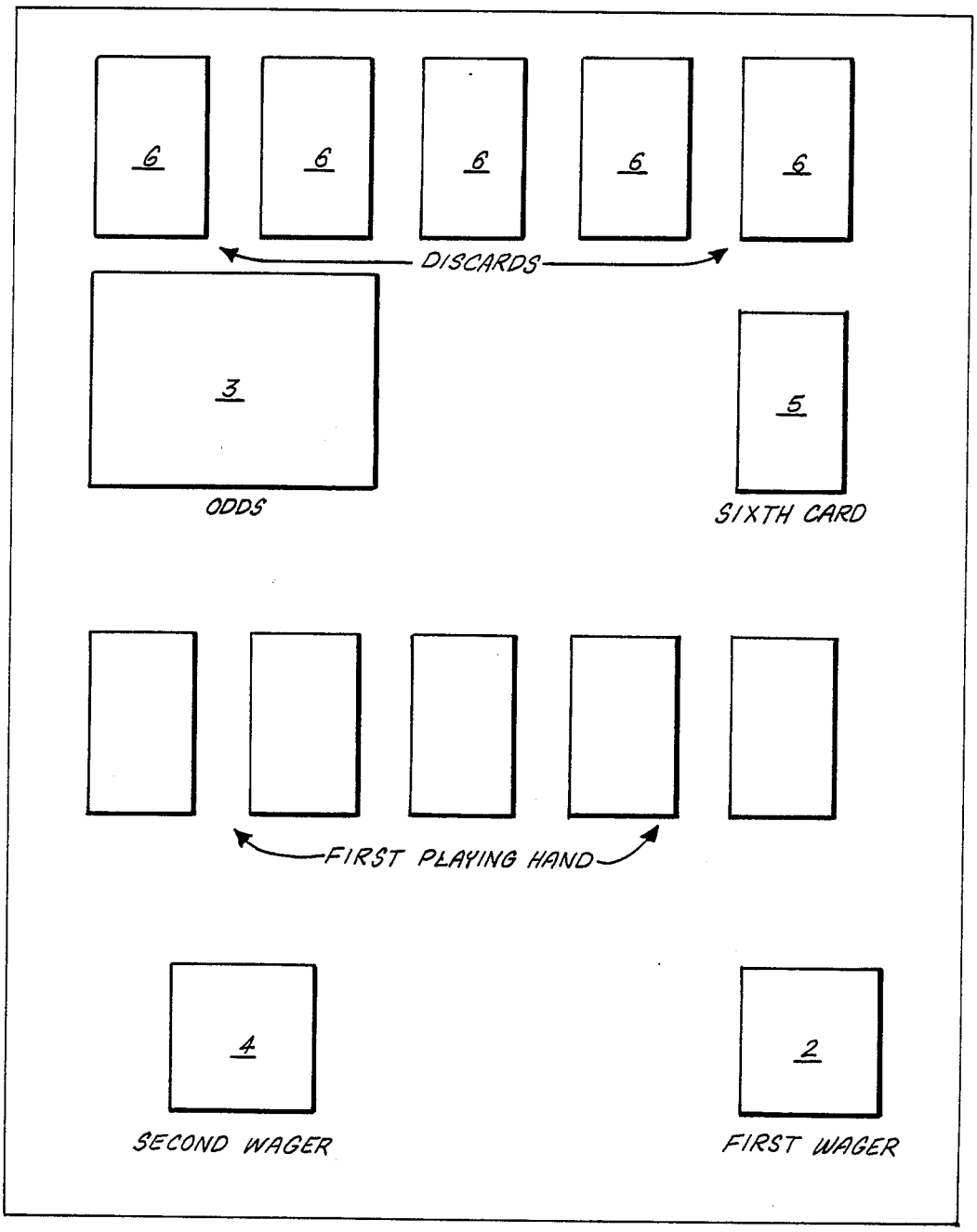
FIG. 1 is illustrative of a preferred embodiment of the gaming table.

Appendix A is the computer software program which is preferred for use to operate a computer and peripheral screen for playing the game.

PREFERRED EMBODIMENTS OF THE INVENTION

In one preferred embodiment, a master deck of 52 standard playing cards which are ranked from low to high in the order of 2, 3, 4, 5, 6, 7, 8, 9, 10, Jack, Queen, King and Ace is utilized along with playing table 1. The player first places a wager in the designated area 2 and is dealt five cards face up which constitutes a first hand. Hands are ranked as follows: high card, a pair, two pairs, three-of-a-kind, straight, flush, full house, four-of-a-kind, and straight flush. The player now elects to discard up to any five cards in the first hand and have them replaced with an equal number of new cards from the pool of cards remaining in the 52-card deck which, with any retained, forms a second hand. In a preferred embodiment, the player loses the first wager if the second hand, or first hand if no cards are discarded, has no pair; receives the wager back if the first hand has a pair; and receives, if the first hand has a higher ranking, an increased amount according to the posted odds 3.

The player may now be entitled to make a second wager by placing it in a designated area 4 and receive a sixth card 5 provided that the sixth card, if dealt, could, when combined with any four of the cards in the second hand, result in a five card third hand having a ranking of a straight or higher and having a ranking higher than the second hand.

In a more preferred embodiment, the player is allowed to see all of the previously discarded cards 6 from the first hand.

If qualified and desired, the player makes a second wager and the sixth card 5 is dealt and turned face up. The highest ranking possible five card hand is then formed from the six cards which constitute the third hand. If the third hand is not of a ranking of a straight or higher and not of a ranking greater than the second hand, the player loses his second wager. However, if the third hand has a ranking of a straight or higher and has a ranking higher than the second hand, then the player wins an amount depending on his second wager and the posted odds 3 which preferably vary depending on the rank of the second hand.

This game may also be played with the use of a computer and video screen. Appendix A details a preferred software program which is written in JANUS/ADA language developed by RR Software, Inc., wherein JANUS/ADA is a subset of ADA (trademark of the U.S. Department of Defense). A brief description of the major software routines is as follows:

PROCEDURE SCP: Main program which executes and displays the 2nd Chance TM Poker Game.

PACKAGE SCP 1: Implements the basic operations needed for creation and display of the various poker hand types.

PACKAGE SCP 2: Implements and displays a button layout for 2nd Chance TM Poker hand.

PACKAGE SCP 3: Allows for the evaluation of a five-card poker hand and a six-card 2nd Chance TM Poker hand.

PACKAGE SCP 4: Determines how many 2nd Chance TM Poker play-offs will be offered to a player and what their value will be.

PACKAGE PLAYCARD: Implements the features of regular playing cards.

PACKAGE SHOWCARD: Allows a playing card to be displayed.

PACKAGE DEALING: Allows for the shuffling and dealing of a deck of cards.

PACKAGE UNIFORM: Generates uniform random numbers.

PACKAGE GRAPHICS: Allows letters and symbols to be displayed on a video display monitor.

PACKAGE TOOLKIT: Routines to facilitate the writing of programs.

The computer also has means for registering a wager.

There are of course alternate embodiments which have not been specifically mentioned, but which are obvious and intended to be included within the scope of the invention as defined by the following claims.

APPENDIX A

```
Current date is Fri   1-03-1986
Enter new date (mm-dd-yy):

 Volume in drive C is HARD DISK
 Directory of  C:\POKER

.              <DIR>      12-27-85   1:54p
..             <DIR>      12-27-85   1:54p
DISKETTE       <DIR>      12-27-85   1:54p
SAVE           <DIR>      12-27-85   1:54p
TEMP           <DIR>      12-27-85   1:54p
SCP1      LIB       512   1-01-86   3:30p
SCP1      PKG      2176   1-01-86   3:36p
SCP1      SYM      1679   1-01-86   3:30p
SCP1      JRL      1849   1-01-86   3:37p
SCP2      LIB       384   1-01-86   3:39p
SCP2      PKG      1152   1-01-86   3:44p
SCP2      SYM      1299   1-01-86   3:39p
SCP2      JRL      1375   1-01-86   3:44p
SCP3      LIB       256   1-01-86   3:45p
SCP3      PKG      5248   1-01-86   4:16p
SCP3      SYM      1228   1-01-86   3:46p
SCP3      JRL      3664   1-01-86   4:17p
SCP4      LIB       640   1-01-86   9:03p
SCP4      PKG      3712   1-02-86  12:59a
SCP4      SYM      1503   1-01-86   9:04p
SCP4      JRL      3342   1-02-86   1:01a
SCP       JRL      5568   1-02-86  10:52a
SCP       SYM      1906   1-02-86  10:52a
SCP       PKG      4608   1-02-86  10:51a
SCP       EXE     69283   1-02-86  10:54a
       25 File(s)    6995968 bytes free
with graphics;
use  graphics;

package scp1 is

   type poker_hand_type is (null_hand,value_pair,pair_of_jacks,pair_of_queens,
        pair_of_kings,pair_of_aces,two_pair,three_of_a_kind,straight,flush,
        full_house,four_of_a_kind,straight_flush,royal_flush);

   five_coin : array(poker_hand_type) of natural;
```

```
   procedure put (item : poker_hand_type);

   procedure first_hand_payouts (position : position_type);

end;

with text_io;
use  text_io;

package body scp1 is

   procedure put (item : poker_hand_type) is
      output : string;
   begin
      case item is
           when royal_flush      => output := "ROYAL FLUSH";
           when straight_flush   => output := "STRAIGHT FLUSH";
           when four_of_a_kind   => output := "4 OF A KIND";
           when full_house       => output := "FULL HOUSE";
           when flush            => output := "FLUSH";
           when straight         => output := "STRAIGHT";
           when three_of_a_kind  => output := "3 OF A KIND";
           when two_pair         => output := "2 PAIR";
           when pair_of_aces     => output := "PAIR OF ACES";
           when pair_of_kings    => output := "PAIR OF KINGS";
           when pair_of_queens   => output := "PAIR OF QUEENS";
           when pair_of_jacks    => output := "PAIR OF JACKS";
           when value_pair       => output := "JACKS OR BETTER";
           when null_hand        => output := "NULL HAND";
      end case;
      put(output);
   end;

   procedure first_hand_payouts (position : position_type) is
      n : natural := 0;
   begin
      single_line;
      box(position,11,27);
      for a in reverse value_pair .. royal_flush loop
          if a not in pair_of_jacks .. pair_of_aces then
             n := n + 1;
             move(position.line + n,position.column + 1);
             put(a); column(position.column + 16); put(" PAYS ");
             put(five_coin(a),4);
          end if;
      end loop;
   end;

begin

   five_coin(royal_flush)      := 4000;
   five_coin(straight_flush)   :=  250;
   five_coin(four_of_a_kind)   :=  125;
   five_coin(full_house)       :=   45;
   five_coin(flush)            :=   30;
   five_coin(straight)         :=   20;
   five_coin(three_of_a_kind)  :=   15;
   five_coin(two_pair)         :=   10;
   five_coin(pair_of_aces)     :=    5;
   five_coin(pair_of_kings)    :=    5;
   five_coin(pair_of_queens)   :=    5;
   five_coin(pair_of_jacks)    :=    5;
   five_coin(value_pair)       :=    5;
   five_coin(null_hand)        :=    0;

end;
with graphics;
use  graphics;

package scp2 is

    type button_type is
         (deal,hold_1,hold_2,hold_3,hold_4,hold_5,draw,second_chance);

    function button return button_type;
```

```
   procedure button_information (position : position_type);

end;

with text_io;
use  text_io;

with toolkit;
use  toolkit;

package body scp2 is

   function button return button_type is
      k : key_type;
      b : button_type;
   begin
      loop
         k := key;
         exit when k /= 9;
      end loop;
      case k is
           when 8 => b := deal;
           when 1 => b := hold_1;
           when 2 => b := hold_2;
           when 3 => b := hold_3;
           when 4 => b := hold_4;
           when 5 => b := hold_5;
           when 6 => b := draw;
           when 7 => b := second_chance;
           when 9 => fatal_error;
           when 0 => move(1,1);
                     halt;
      end case;
      return b;
   end;

   procedure button_information (position : position_type) is
   begin
      single_line;
      box(position,6,16);
      move(position.line + 1,position.column + 1); put("1-5 HOLD");
      move(position.line + 2,position.column + 1); put("  6 DRAW");
      move(position.line + 3,position.column + 1); put("  7 2nd CHANCE");
      move(position.line + 4,position.column + 1); put("  8 DEAL");
   end;

end;
with playcard;
use  playcard;

with scp1;
use  scp1;

package scp3 is

   card : array(1 .. 6) of card_type;

   function evaluate_first_hand return poker_hand_type;

   function evaluate_second_chance return poker_hand_type;

end;
with toolkit;
use  toolkit;

package body scp3 is

   type hand_type is array(1 .. 5) of card_type;

   function evaluate (hand : hand_type) return poker_hand_type is

      answer : poker_hand_type;
```

```
   rank_count : array(rank_type) of integer range 0 .. 4;
   suit_count : array(suit_type) of integer range 0 .. 5;
   meta_rank  : array(0 .. 4)    of integer range 0 .. 13;
   meta_suit  : array(0 .. 5)    of integer range 0 .. 4;

   straight_flag : boolean;

begin

   for a in rank_count'range loop  rank_count(a)  := 0;  end loop;
   for a in suit_count'range loop  suit_count(a)  := 0;  end loop;
   for a in meta_rank'range  loop  meta_rank(a)   := 0;  end loop;
   for a in meta_suit'range  loop  meta_suit(a)   := 0;  end loop;

   for a in hand'range loop
       rank_count(rank(hand(a))) := rank_count(rank(hand(a))) + 1;
       suit_count(suit(hand(a))) := suit_count(suit(hand(a))) + 1;
   end loop;

   for a in rank_count'range loop
       meta_rank(rank_count(a)) := meta_rank(rank_count(a)) + 1;
   end loop;

   for a in suit_count'range loop
       meta_suit(suit_count(a)) := meta_suit(suit_count(a)) + 1;
   end loop;

   if rank_count(ace)  = 1 and rank_count(deuce) = 1 and
      rank_count(trey) = 1 and rank_count(four)  = 1 and
      rank_count(five) = 1 then
      straight_flag := true;
   else
      straight_flag := false;
      for a in deuce .. ten loop
          if rank_count(a) = 1 then
             if rank_count(rank_type'val(rank_type'pos(a) + 1)) = 1 and
                rank_count(rank_type'val(rank_type'pos(a) + 2)) = 1 and
                rank_count(rank_type'val(rank_type'pos(a) + 3)) = 1 and
                rank_count(rank_type'val(rank_type'pos(a) + 4)) = 1 then
                straight_flag := true;
             end if;
             exit;  --  optimization
          end if;
      end loop;
   end if;

   if straight_flag and meta_suit(5) = 1 then
      if rank_count(ace) = 1 and rank_count(king) = 1 then
         answer := royal_flush;
      else
         answer := straight_flush;
   end if;
elsif meta_rank(4)      then
   answer := four_of_a_kind;
elsif meta_rank(3) = 1 and meta_rank(2) = 1 then
   answer := full_house;
elsif meta_suit(5) = 1 then
   answer := flush;
elsif straight_flag then
   answer := straight;
elsif meta_rank(3) = 1 then
   answer := three_of_a_kind;
elsif meta_rank(2) = 2 then
   answer := two_pair;
elsif rank_count(ace) = 2 then
   answer := pair_of_aces;
elsif rank_count(king) = 2 then
   answer := pair_of_kings;
elsif rank_count(queen) = 2 then
   answer := pair_of_queens;
elsif rank_count(jack) = 2 then
   answer := pair_of_jacks;
else
   answer := null_hand;
end if;
```

```
      return answer;

   end evaluate;

   function evaluate_first_hand return poker_hand_type is
      answer : poker_hand_type;
      hand   : hand_type;
   begin
      check(card(6) = null_card);
      for a in 1 .. 5 loop
          hand(a) := card(a);
      end loop;
      answer := evaluate(hand);
      if answer in pair_of_jacks .. pair_of_aces then
         answer := value_pair;
      end if;
      return answer;
   end;

   function evaluate_second_chance return poker_hand_type is
      answer        : poker_hand_type;
      hand          : hand_type;
      five_cards    : poker_hand_type;
      intermediate  : poker_hand_type;
      six_cards     : poker_hand_type := null_hand;
      n             : natural         := 0;
   begin
      check(card(6) /= null_card);
      for a in 1 .. 5 loop
          hand(a) := card(a);
      end loop;
      five_cards := evaluate(hand);
      for replace in 1 .. 5 loop
          for a in 1 .. 5 loop
              hand(a) := card(a);
          end loop;
          hand(replace) := card(6);
          intermediate  := evaluate(hand);
          if intermediate > six_cards then
             six_cards := intermediate;
          end if;
      end loop;
      if six_cards > five_cards then
         answer := six_cards;
      else
         for a in 1 .. 5 loop
             if rank(card(a)) = rank(card(6)) then
                n := n + 1;
             end if;
         end loop;
         if n = 1 and rank(card(6)) in jack .. ace then
            case rank(card(6)) is
                 when ace    => answer := pair_of_aces;
                 when king   => answer := pair_of_kings;
                 when queen  => answer := pair_of_queens;
                 when jack   => answer := pair_of_jacks;
                 when others => fatal_error;
            end case;
         else
            answer := null_hand;
                      --  in this case, null_hand signifies that there was no
                      --  improvement with the addition of the 2nd Chance card.
         end if;
      end if;
      return answer;
   end;

end;
```

→ Six Cards := intermediate

```
with graphics;
use  graphics;

with scp1;
use  scp1;

package scp4 is

   type payoff_type is
        record
           category : poker_hand_type range pair_of_jacks .. royal_flush;
           coins    : integer range 5 .. 235;
        end record;

   procedure initialize_second_chance;

   number_of_payoffs : integer range 0 .. 8;
   payoff            : array(1 .. 8) of payoff_type;

   procedure deal_second_chance;

   winner : integer range 0 .. 8;

   procedure put_house_edge (position : position_type);

end;
with text_io;
use  text_io;

with playcard,toolkit,dealing;
use  playcard,toolkit,dealing;

with scp3;
use  scp3;

package body scp4 is

   house_edge : string := "";

   procedure initialize_second_chance is

      unseen_cards : natural := 0;
      frequency    : array(pair_of_jacks .. royal_flush) of natural;
      intermediate : poker_hand_type;
      sum          : natural := 0;
      edge         : float;
      switch       : boolean;
      temp         : payoff_type;

   begin

      for a in frequency'range loop
          frequency(a) := 0;
      end loop;

      reset_peek;
      while more_to_peek loop
            card(6)       := peek;
            unseen_cards  := unseen_cards + 1;
            intermediate := evaluate_second_chance;
            if intermediate in pair_of_jacks .. royal_flush then
               frequency(intermediate) := frequency(intermediate) + 1;
            end if;
      end loop;
      card(6) := null_card;

      number_of_payoffs := 0;
      for a in reverse straight .. royal_flush loop
          if frequency(a) >= 1 then
             number_of_payoffs := number_of_payoffs + 1;
             payoff(number_of_payoffs).category := a;
          end if;
      end loop;
```

```
if number_of_payoffs > 2 then
   number_of_payoffs := 2;
end if;

if number_of_payoffs = 2 then
   payoff(2).coins := 10;
end if;

if number_of_payoffs = 0 then

   house_edge := "";

else
     for a in reverse pair_of_jacks .. three_of_a_kind loop
         if frequency     >= 1 then
            number_of_payoffs := number_of_payoffs + 1;
            payoff(number_of_payoffs).category := a;
            payoff(number_of_payoffs).coins     := five_coin(a);
         end if;
     end loop;

     for a in 2 .. number_of_payoffs loop
         sum := sum + frequency(payoff(a).category) * payoff(a).coins;
     end loop;

     payoff(1).coins := 5 * ((unseen_cards - (sum / 5)) /
                              frequency(payoff(1).category));

     sum := sum + frequency(payoff(1).category) * payoff(1).coins;

     edge := 100.0 * (1.0 - (float(sum) / float(unseen_cards * 5)));

     if edge = 0.0 then
         house_edge := "DEAD EVEN";
      elsif edge > 0.0 then
         put(house_edge,edge,2,0);
         house_edge := house_edge & " %";
      else
         fatal_error;
      end if;

      loop  -- sort payouts by coins paid and poker ranking
         switch := false;
         for a in 1 .. number_of_payoffs - 1 loop
             if payoff(a).coins < payoff(a + 1).coins then
                temp           := payoff(a);
                payoff(a)      := payoff(a + 1);
                payoff(a + 1)  := temp;
                switch := true;
             end if;
         end loop;
         exit when not switch;
      end loop;

   end if;

end initialize_second_chance;

procedure deal_second_chance is
   second_chance_hand : poker_hand_type;
begin
   card(6) := deal;
   second_chance_hand := evaluate_second_chance;
   winner := 0;
   for a in 1 .. number_of_payoffs loop
       if payoff(a).category = second_chance_hand then
          winner := a;
       end if;
   end loop;
end;

procedure put_house_edge (position : position_type) is
begin
   move(position);
```

```
   put("HOUSE EDGE : "); put(house_edge);
   house_edge := "";
end;
end;



with text_io;
use  text_io;

with playcard,toolkit,graphics,showcard,uniform,dealing;
use  playcard,toolkit,graphics,showcard;

with scp1,scp2,scp3,scp4;
use  scp1,scp2,scp3,scp4;

procedure scp is

   p : array(1 .. 6) of position_type;  --  card positions on the monitor
   h : array(1 .. 5) of boolean;        --  cards to hold

   procedure hold (card_number : positive) is
   begin
      check(card_number in 1 .. 5);
      h(card_number) := not h(card_number);
      move(p(card_number).line + 5,p(card_number).column + 2);
      if h(card_number) then
         put("HOLD");
      else
         put("    ");
      end if;
   end;

   procedure game_over is
   begin
      move(1,72);
      put("GAME OVER");
   end;

begin

   for a in 1 .. 5 loop
       p(a) := create(4,(a - 1) * 9 + 1);
   end loop;
   p(6) := create(6,51);

   uniform.randomly_initialize;

   first_hand_payouts(create(15, 1));
   button_information(create(20,29));

   loop

      <<start>>

      for a in line_range loop
          case a is
               when  1 .. 14 => move(a, 1);
               when 15 .. 19 => move(a,28);
               when 20 .. 25 => move(a,45);
          end case;
          erase_line;
      end loop;

      dealing.reset_deal;
      for a in 1 .. 5 loop
          card(a) := dealing.deal;
      end loop;
```

```
end loop; END LOOP
card(6) := null_card;

for a in h'range lo
    h(a) := false;
end loop;

for a in 1 .. 5 loop
    card_back(p(a));
end loop;

for a in 1 .. 5 loop
    pause(0.7);
    card_front(p(a),card(a));
end loop;

loop
   case button is
        when hold_1 => hold(1);
        when hold_2 => hold(2);
        when hold_3 => hold(3);
        when hold_4 => hold(4);
        when hold_5 => hold(5);
        when draw   => exit;
        when others => null;
   end case;
end loop;

for a in 1 .. 5 loop
    if not h(a) then
       card(a) := dealing.deal;
       card_back(p(a));
    end if;
end loop;

for a in 1 .. 5 loop
    if not h(a) then
       pause(0.5);
       card_front(p(a),card(a));
    end if;
end loop;

if evaluate_first_hand >= value_pair then
   move(1,1);
   put("WINNER  ** ");
   put(five_coin(evaluate_first_hand),3);
   put(" COINS PAID");
end if;

initialize_second_chance;

if number_of_payoffs >= 1 then

   move(p(6).line - 3,p(6).column + 2); put("2nd");
   move(p(6).line - 2,p(6).column);     put("CHANCE");

   double_line;
   box(create(p(6).line - 1,p(6).column - 2),7,11);
   logo_back(p(6));

   move(13,41);
   put("DO YOU WANT A '2nd CHANCE' ?");
   single_line;
   box(create(14,42),number_of_payoffs + 2,25);

   for a in 1 .. number_of_payoffs loop
      move(14 + a, 43);
      put(payoff(a).category);
      move(14 + a,57);
      put(" PAYS ");
      put(payoff(a).coins,3);
end loop;

loop
```

```
            case button is

               when second_chance =>

                  pause(1.5);
                  deal_second_chance;
                  card_front(p(6),card(6));

                  if winner >= 1 then
                     move(2,1);
                     put("WINNER  ** ");
                     put(payoff(winner).coins,3);
                     put(" COINS PAID - 2nd CHANCE");
                     save_graphics;
                     blink;
                     move(14 + winner,43);
                     put(payoff(winner).category);
                     move(14 + winner,57);
                     put(" PAYS ");
                     put(payoff(winner).coins,3);
                     restore_graphics;
                  end if;

                  put_house_edge(create(25,55));

                  move(23,1);
                  pause(0.7);
                  exit;

               when deal =>

                  pause(2.0);
                  game_over;
                  pause(2.0);
                  goto start;

               when others =>

                  null;

            end case;

         end loop;

      end if;

      game_over;

      loop
         exit when button = deal;
      end loop;

   end loop;

end;
Current date is Wed 12-18-1985


 Volume in drive C is HARD DISK
 Directory of  C:\LIBRARY

.              <DIR>      10-24-85  12:46p
..             <DIR>      10-24-85  12:46p
PLAYCARD LIB      1190  12-18-85   9:00p
PLAYCARD PKG      1399  12-18-85   9:00p
PLAYCARD SYM      2689  12-18-85   9:00p
PLAYCARD JRL      1392  12-18-85   9:01p
TOOLKIT  LIB       603  12-18-85   9:00p
TOOLKIT  PKG      2132  12-18-85   9:00p
TOOLKIT  SYM      1936  12-18-85   9:01p
TOOLKIT  JRL      2869  12-18-85   9:02p
UNIFORM  LIB       227  12-18-85   9:00p
UNIFORM  PKG      1066  12-18-85   9:00p
UNIFORM  SYM       673  12-18-85   9:03p
```

```
UNIFORM  JRL     1525  12-18-85   9:03p
DEALING  LIB      850  12-18-85   9:00p
DEALING  PKG     3046  12-18-85   9:00p
DEALING  SYM     1877  12-18-85   9:03p
DEALING  JRL     3689  12-18-85   9:04p
GRAPHICS LIB     1921  12-18-85   9:00p
GRAPHICS PKG     7218  12-18-85   9:00p
GRAPHICS SYM     5253  12-18-85   9:05p
GRAPHICS JRL     9197  12-18-85   9:06p
SHOWCARD LIB      316  12-18-85   9:00p
SHOWCARD PKG     2559  12-18-85   9:00p
SHOWCARD SYM     1366  12-18-85   9:07p
SHOWCARD JRL     3252  12-18-85   9:08p
       26 File(s)   7262208 bytes free
```

```
-- december 18, 1985  9:00 pm  wednesday evening

package playcard is

   type card_type is private;

   type full_rank is (null_rank,deuce,trey,four,five,six,seven,eight,nine,ten,
                      jack,queen,king,ace,joker_rank);

   type full_suit is (null_suit,hearts,clubs,diamonds,spades,joker_suit);

   type full_color is (null_color,red,black,joker_color);

   subtype rank_type is full_rank range deuce .. ace;

   subtype suit_type is full_suit range hearts .. spades;

   subtype color_type is full_color range red .. black;

   function null_card return card_type;

   function joker_card return card_type;

   function create (rank : rank_type; suit : suit_type) return card_type;

   function rank (card : card_type) return full_rank;

   function suit (card : card_type) return full_suit;

   function color (card : card_type) return full_color;

private

   type card_type is
        record
           rank   : full_rank;
           suit   : full_suit;
           filler : byte;  --  the compiler requires composite types which are
                           --  private to be at least 3 bytes long
        end record;

end;
-- december 18, 1985  9:00 pm  wednesday evening

package body playcard is

   function null_card return card_type is
      card : card_type;
   begin
      card.rank   := null_rank;
      card.suit   := null_suit;
      card.filler := byte(0);
      return card;
   end;

   function joker_card return card_type is
      card : card_type;
   begin
      card.rank   := joker_rank;
      card.suit   := joker_suit;
```

```
      card.filler := byte(0);
      return card;
   end;

   function create (rank : rank_type; suit : suit_type) return card_type is
      card : card_type;
   begin
      card.rank   := rank;
      card.suit   := suit;
      card.filler := byte(0);
      return card;
   end;

   function rank (card : card_type) return full_rank is
   begin
      return card.rank;
   end;

   function suit (card : card_type) return full_suit is
   begin
      return card.suit;
   end;

   function color (card : card_type) return full_color is
      color : full_color;
   begin
      case suit(card) is
           when null_suit  => color := null_color;
           when hearts     => color := red;
           when clubs      => color := black;
           when diamonds   => color := red;
           when spades     => color := black;
           when joker_suit => color := joker_color;
    - end case;
      return color;
   end;

end;

--  december 18, 1985  9:00 pm  wednesday evening

with text_io;

package toolkit is

   type key_type is range 0 .. 9;

   subtype real is long_float;

   keyboard : text_io.file_type;

   function key return key_type;

   procedure space (number_of_spaces : natural);
   procedure space;

   procedure end_line;

   procedure skip (number_of_lines : natural);
   procedure skip;

   procedure sound;

   procedure pause (number_of_seconds : real);

   procedure pause;

   procedure halt;

   procedure fatal_error;

   procedure check (assertion : boolean);

end;
```

```
--  december 18, 1985  9:00 pm  wednesday evening

with calendar,strlib,util;

use text_io;

package body toolkit is

   function key return key_type is
      input : character;
   begin
      loop
         get(keyboard,input);
         exit when input in '0' .. '9';
      end loop;
      return key_type(strlib.str_to_int(strlib.char_to_str(input)));
   end;

   procedure space (number_of_spaces : natural) is
   begin
      for a in 1 .. number_of_spaces loop
          put(' ');
      end loop;
   end;

   procedure space is
   begin
      space(1);
   end;

   procedure end_line is
   begin
      new_line;
   end;

   procedure skip (number_of_lines : natural) is
   begin
      for a in 1 .. number_of_lines loop
          new_line;
      end loop;
   end;

   procedure skip is
   begin
      skip(1);
   end;

   procedure sound is
   begin
      put(standard_output,ascii.bel);
   end;

   procedure pause (number_of_seconds : real) is
      use calendar;
      initial    : constant day_duration := seconds(clock);
      current    : day_duration;
      cumulative : duration;
   begin
      loop
         current := seconds(clock);
         if current >= initial then
          cumulative := current - initial;
       else
          cumulative := 24.0 * 60.0 ** 2 - initial + current;
       end if;
       exit when cumulative >= number_of_seconds;
    end loop;
end;

procedure pause is
   dummy : character;
begin
   put(standard_output,"press any key to continue  ");
   get(keyboard,dummy);
```

```
   end;

   procedure halt is
   begin
      util.halt;
   end;

   procedure fatal_error is
   begin
      sound;
      set_output(standard_output);
      new_line;
      put_line("a fatal error has occurred");
      put_line("a janus/ada error walkback will follow");
      pause;
      util.err_exit;
   end;

   procedure check (assertion : boolean) is
   begin
      if not assertion then
         fatal_error;
      end if;
   end;

begin

   open(keyboard,in_file,"KBD:");

end;
--  december 18, 1985  9:00 pm  wednesday evening

with toolkit;
use -toolkit;

with calendar,random;

package body uniform is

   procedure initialize (a,b,c : integer) is
   begin
      random.set_seed(a,b,c);
   end;

   procedure randomly_initialize is
      use calendar;
      datetime : constant time          := clock;
      year     : constant year_number   := year(datetime);
      month    : constant month_number  := month(datetime);
      day      : constant day_number    := day(datetime);
      seconds  : constant duration      := seconds(datetime);
   begin
      initialize(year + month + day,
                 integer(seconds / 3.0),
                 integer((seconds - real(integer(seconds))) * 10000.0));
   end;

   function generator (low,high : integer) return integer is
      answer : integer;
   begin
      check(low <= high);
      answer := low + integer(random.rand * real(high - low + 1) - 0.5);
      check(answer in low .. high);
      return answer;
   end;

begin

   initialize(0,0,0);

end;
```

```
-- december 18, 1985  9:00 pm  wednesday evening

package uniform is

   procedure initialize (a,b,c : integer);

   procedure randomly_initialize;

   function generator (low,high : integer) return integer;

end;
-- december 18, 1985  9:00 pm  wednesday evening

with playcard;
use  playcard;

package dealing is

   deck_limit : constant := 20;

   subtype deck_range is integer range 1 .. deck_limit;

   procedure create (deuces,treys,fours,fives,sixes,sevens,eights,nines,tens,
                     jacks,queens,kings,aces,jokers : natural);

   procedure create_deck_with_joker;

   procedure create (decks : deck_range);

   procedure reset_deal;

   function deal return card_type;

   --  the following three routines allow you to 'peek' at cards in the pack
   --  that are not yet dealt. when these routines are used, no other routines
   --  in this package should be called, until you are through peeking.

   procedure reset_peek;

   function more_to_peek return boolean;

   function peek return card_type;

end;
-- december 18, 1985  9:00 pm  wednesday evening

with toolkit,uniform;
use  toolkit;

package body dealing is

   card_limit            : constant := 52 * deck_limit;
   pack                  : array(1 .. card_limit) of card_type;
   number_of_cards       : integer range 0 .. card_limit;
   previous_card_dealt   : integer range 0 .. card_limit;
   previous_card_peeked  : integer range 0 .. card_limit;

   procedure create (deuces,treys,fours,fives,sixes,sevens,eights,nines,tens,
                     jacks,queens,kings,aces,jokers : natural) is

      procedure insert (rank : rank_type; n : natural) is
         count : natural := 0;
      begin
         generate :
         while n >= 1 loop
            for suit in suit_type loop
                number_of_cards        := number_of_cards + 1;
                pack(number_of_cards)  := create(rank,suit);
                count := count + 1;
                exit generate when count = n;
            end loop;
         end loop generate;
      end;
```

```
begin

   for a in pack'range loop
       pack(a) := null_card;
   end loop;

   number_of_cards := 0;

   insert(deuce,deuces);
   insert(trey ,treys );
   insert(four ,fours );
   insert(five ,fives );
   insert(six  ,sixes );
   insert(seven,sevens);
   insert(eight,eights);
   insert(nine ,nines );
   insert(ten  ,tens  );
   insert(jack ,jacks );
   insert(queen,queens);
   insert(king ,kings );
   insert(ace  ,aces  );

   for a in 1 .. jokers loop
       number_of_cards       := number_of_cards + 1;
       pack(number_of_cards) := joker_card;
   end loop;

   previous_card_dealt := 0;

end create;
procedure create_deck_with_joker is
begin
   create(4,4,4,4,4,4,4,4,4,4,4,4,1);
end;

procedure create (decks : deck_range) is
   n : constant positive := 4 * decks;
begin
   create(n,n,n,n,n,n,n,n,n,n,n,n,n,0);
end;

procedure reset_deal is
begin
   previous_card_dealt := 0;
end;

function deal return card_type is
   n    : constant integer range 1 .. number_of_cards :=
                   previous_card_dealt + 1;
   pick : constant integer range n .. number_of_cards :=
                   uniform.generator(n,number_of_cards);
   temp : card_type;
begin
   temp       := pack(n);
   pack(n)    := pack(pick);
   pack(pick) := temp;
   previous_card_dealt := n;
   return pack(n);
end;

procedure reset_peek is
begin
   check(previous_card_dealt in 0 .. number_of_cards);
   previous_card_peeked := previous_card_dealt;
end;

function more_to_peek return boolean is
begin
   return previous_card_peeked < number_of_cards;
end;

function peek return card_type is
begin
```

```
      check(more_to_peek);
      previous_card_peeked := previous_card_peeked + 1;
      return pack(previous_card_peeked);
   end;

begin

   create(1);

end;
   procedure blanks;
   procedure single_line;
   procedure double_line;

   procedure box (position : position_type; height,width : positive);

   procedure box (line : line_range; column : column_range;
                  height,width : positive);

end;
--  december 18, 1985  9:00 pm  wednesday evening

with text_io;

package graphics is

   type character_range is range 0 .. 255;

   subtype line_range   is integer range 1 .. 25;
   subtype column_range is integer range 1 .. 80;

   type position_type is
        record
           line   : line_range;
           column : column_range;
        end record;

   function create (line : line_range; column : column_range) return
            position_type;

   function cursor return position_type;

   procedure show (file : text_io.file_type; item : character_range);
   procedure show (item : character_range);

   procedure move (position : position_type);
   procedure move (line : line_range; column : column_range);

   procedure line   (line   : line_range);
   procedure column (column : column_range);

   procedure up (number_of_lines : natural);
   procedure up;
   procedure down (number_of_lines : natural);
   procedure down;
   procedure forward (number_of_columns : natural);
   procedure forward;
   procedure backward (number_of_columns : natural);
   procedure backward;

   procedure bold;
   procedure underline;
   procedure blink;
   procedure reverse_video;
   procedure set (bold,underline,blink,reverse_video : boolean);
   procedure normal;

   procedure conceal;

   procedure erase_line;
   procedure erase_display;

   procedure save_graphics;
   procedure restore_graphics;
```

```
procedure save_cursor;
procedure restore_cursor;

procedure set (vertical,horizontal,upper_left,upper_right,lower_left,
               lower_right,interior : character_range);
   buffer : string(8) := "        ";
begin
   escape("[6n");
   for a in 1 .. 8 loop
       get(keyboard,buffer(a));
   end loop;
   if buffer(1) = ascii.esc and buffer(2) = '[' and buffer(5) = ';' and
      buffer(8) = 'R' then
      return create(str_to_int(extract(buffer,3,2)),
                    str_to_int(extract(buffer,6,2)));
   else
      end_line;
      normal;
      put_line(buffer);
      fatal_error;
   end if;
end;

procedure show (file : file_type; item : character_range) is
begin
   pragma rangecheck(off);
   put(file,character'val(item));
   pragma rangecheck(on);
end;

procedure show (item : character_range) is
begin
   show(current_output,item);
end;

procedure move (position : position_type) is
begin
   escape("[" & int_to_str(position.line)   & ";" &
                int_to_str(position.column) & "H");
end;

procedure move (line : line_range; column : column_range) is
begin
   move(create(line,column));
end;

procedure line (line : line_range) is
begin
   move(line,cursor.column);
end;

procedure column (column : column_range) is
begin
   move(cursor.line,column);
end;

procedure up (number_of_lines : natural) is
begin
   case number_of_lines is
        when      0 => null;
        when others => escape("[" & int_to_str(number_of_lines) & "A");
   end case;
end;

procedure up is
begin
   up(1);
end;

procedure down (number_of_lines : natural) is
begin
```

```
-- december 18, 1985  9:00 pm  wednesday evening

with toolkit;
use  toolkit;

with strlib;
use  strlib;

use  text_io;

package body graphics is

   max : constant := 4;

   type stack_range is range 1 .. max;

   type graphics_state_type is
        record
           bold          : boolean;
           underline     : boolean;
           blink         : boolean;
           reverse_video : boolean;
        end record;

   stack : array(stack_range) of graphics_state_type;
   n     : stack_range := 1;

   vertical    : character_range;
   horizontal  : character_range;
   upper_left  : character_range;
   upper_right : character_range;
   lower_left  : character_range;
   lower_right : character_range;
   interior    : character_range;

   procedure escape (sequence : string) is
   begin
      put(standard_output,ascii.esc);
      put(standard_output,sequence);
   end;

   procedure transmit is
      s : string := "[0";
   begin
      if stack(n).bold           then s := s & ";1"; end if;
      if stack(n).underline      then s := s & ";4"; end if;
      if stack(n).blink          then s := s & ";5"; end if;
      if stack(n).reverse_video then s := s & ";7"; end if;
      escape(s & "m");
   end;

   function create (line : line_range; column : column_range) return
            position_type is
      position : position_type;
   begin
      position.line   := line;
      position.column := column;
      return position;
   end;

   function cursor return position_type is
   case number_of_lines is
        when      0 => null;
        when others => escape("[" & int_to_str(number_of_lines) & "B");
   end case;
end;

procedure down is
begin
   down(1);
end;

procedure forward (number_of_columns : natural) is
begin
```

```
   case number_of_columns is
        when      0 => null;
        when others => escape("[" & int_to_str(number_of_columns) & "C");
   end case;
end;

procedure forward is
begin
   forward(1);
end;

procedure backward (number_of_columns : natural) is
begin
   case number_of_columns is
        when      0 => null;
        when others => escape("[" & int_to_str(number_of_columns) & "D");
   end case;
end;

procedure backward is
begin
   backward(1);
end;

procedure bold is
begin
   stack(n).bold := true;
   escape("[1m");
end;

procedure underline is
begin
   stack(n).underline := true;
   escape("[4m");
end;

procedure blink is
begin
   stack(n).blink := true;
   escape("[5m");
end;

procedure reverse_video is
begin
   stack(n).reverse_video := true;
   escape("[7m");
end;

procedure set (bold,underline,blink,reverse_video : boolean) is
begin
   stack(n).bold          := bold;
   stack(n).underline     := underline;
   stack(n).blink         := blink;
   stack(n).reverse_video := reverse_video;
   transmit;
end;

procedure normal is
begin
   set(false,false,false,false);
end;

procedure conceal is
begin
   save_graphics;
   escape("[0;8m");
end;

procedure erase_line is
begin
   escape("[K");
end;

procedure erase_display is
```

```
begin
   escape("[2J");
end;

procedure save_graphics is
begin
   n := n + 1;
   stack(n) := stack(n - 1);
end;

procedure restore_graphics is
begin
   n := n - 1;
   transmit;
end;

procedure save_cursor is
begin
   escape("[s");
end;

procedure restore_cursor is
begin
   escape("[u");
end;

procedure set (vertical,horizontal,upper_left,upper_right,lower_left,
               lower_right,interior : character_range) is
begin
   graphics.vertical     := vertical;
   graphics.horizontal   := horizontal;
   graphics.upper_left   := upper_left;
   graphics.upper_right  := upper_right;
   graphics.lower_left   := lower_left;
   graphics.lower_right  := lower_right;
   graphics.interior     := interior;
end;

procedure blanks is
begin
   set(32,32,32,32,32,32,32);
end;

procedure single_line is
begin
   set(179,196,218,191,192,217,32);
end;

procedure double_line
begin
   set(186,205,201,187,200,188,32);
end;

procedure box (position : position_type; height,width : positive) is

   line : string;

   procedure set (left,middle,right : character_range) is
   begin
      pragma rangecheck(off);
      line := char_to_str(character'val(left));
      for a in 1 .. width - 2 loop
          line := line & char_to_str(character'val(middle));
      end loop;
      line := line & char_to_str(character'val(right));
      pragma rangecheck(on);
   end;

begin

   move(position);
   set(upper_left,horizontal,upper_right);
   put(line);
```

```
      set(vertical,interior,vertical);
      for a in 1 .. height - 2 loop
          move(position.line + a,position.column);
          put(line);
      end loop;

      move(position.line + height - 1,position.column);
      set(lower_left,horizontal,lower_right);
      put(line);

   end;

   procedure box (line : line_range; column : column_range;
                  height,width : positive) is
   begin
      box(create(line,column),height,width);
   end;

begin

   normal;
   erase_display;
   single_line;

end;
--  december 18, 1985  9:00 pm  wednesday evening

with graphics,playcard;
use  graphics,playcard;

package showcard is

   procedure card_back (position : position_type);

   procedure logo_back (position : position_type);

   procedure card_front (position : position_type; card : card_type);

end;
--  december 18, 1985  9:00 pm  wednesday evening

with text_io;
use  text_io;

package body showcard is

   procedure card_back (position : position_type) is
   begin

      move(position);
      for a in 1 .. 7 loop
          show(220);
      end loop;

      for a in 1 .. 3 loop
          move(position.line + a,position.column);
          for b in 1 .. 7 loop
              show(219);
          end loop;
      end loop;

      move(position.line + 4,position.column);
      for a in 1 .. 7 loop
          show(223);
      end loop;

   end;
```

```
procedure logo_back (position : position_type) is
begin
   card_back(position);
   save_graphics;
   reverse_video;
   move(position.line + 1,position.column);  put("  Mid- ");
   move(position.line + 2,position.column);  put(" Games,");
   move(position.line + 3,position.column);  put("  Inc. ");
   restore_graphics;
end;

function image (rank : rank_type) return string(2) is
   image : string(2);
begin
   case rank is
        when deuce => image := "2 ";
        when trey  => image := "3 ";
        when four  => image := "4 ";
        when five  => image := "5 ";
        when six   => image := "6 ";
        when seven => image := "7 ";
        when eight => image := "8 ";
        when nine  => image := "9 ";
        when ten   => image := "10";
        when jack  => image := "J ";
        when queen => image := "Q ";
        when king  => image := "K ";
        when ace   => image := "A ";
   end case;
   return image;
end;
   function image (suit : suit_type) return character is
      image : character;
   begin
      case suit is
           when hearts   => image := character'val(3);
           when diamonds => image := character'val(4);
           when clubs    => image := character'val(5);
           when spades   => image := character'val(6);
      end case;
      return image;
   end;

   procedure card_front (position : position_type; card : card_type) is
   begin
      double_line;
      box(position,5,7);
      move(position.line + 2,position.column + 3);  put(image(rank(card)));
      move(position.line + 1,position.column + 1);  put(image(suit(card)));
      forward(3);                                   put(image(suit(card)));
      move(position.line + 3,position.column + 1);  put(image(suit(card)));
      forward(3);                                   put(image(suit(card)));
   end;

end;
```

What I claim is:

1. A method of playing a casino-type draw poker game using a computer and video screen wherein five card hands are ranked from low to high in order of high card, pair, two-pair, three-of-a-kind, straight, flush, full house, four-of-a-kind and straight flush, which comprises the steps of:

(a) a player registering a first wager with said computer;

(b) said computer randomly generating and displaying five cards from a pool comprising elements corresponding to a standard 52 playing card deck, said five cards forming a first hand;

(c) said player directing said computer to discard up to five cards from said first hand;

(d) said computer randomly generating and displaying a replacement card, from a balance of cards in said pool, for each card discarded from said first hand, said replacement cards and undiscarded cards from said first hand forming a second hand;

(e) said computer comparing a rank of said second hand to an odds chart to determine if said player has lost or won an amount based on said first wager;

(f) said computer offering said player an opportunity to register a second wager if there is a possibility of a third hand having a rank of straight or higher, said third hand being the highest ranking five card hand which can be made using said second hand and a sixth card randomly generated from a balance of cards in said pool;

(g) if a possibility of said third hand having a rank of straight or higher exists, said player electing to terminate said game or to register said second wager with said computer;

(h) if said player registers said second wager, said computer randomly generating said sixth card from a balance of cards in said pool; and (i) said computer comparing a rank of said third hand to said odds chart to determine if said player has lost or won an amount based on said second wager.

2. A method according to claim 1, wherein said election to make a second wager is offered only if said sixth card would also create the possibility of said third hand having a rank higher than said second hand.

3. A method according to claim 2, wherein said odds chart is varied depending on the rank of said second hand.

4. A method of playing a casino-type draw poker game wherein five card hands are ranked from low to high in order of high card, pair, two-pair, three-of-a-kind, straight, flush, full house, four-of-a-kind and straight flush, which comprises the steps of:

(a) a player placing a first wager on a playing table;

(b) said player being dealt five random cards from a pool comprising a standard 52 playing card deck, said five cards forming a first hand;

(c) said player choosing to discard up to five cards from said first hand;

(d) said player being randomly dealt a replacement card from a balance of cards in said pool, for each card discarded from said first hand, said replacement cards and undiscarded cards from said first hand forming a second hand;

(e) comparing a rank of said second hand to an odds chart to determine if said player has lost or won an amount based on said first wager;

(f) said player being offered an opportunity to place a second wager if there is a possibility of a third hand having a rank of straight or higher, said third hand being the highest ranking five card hand which can be made using said second hand and a sixth card randomly dealt from a balance of cards in said pool;

(g) if a possibility of said third hand having a rank of straight or higher exists, said player electing to terminate said game or to place said second wager on said playing table;

(h) if said player places said second wager, said player being randomly dealt said sixth card from a balance of cards in said pool; and (i) comparing a rank of said third hand to said odds chart to determine if said player has lost or won an amount based on said second wager.

5. A method according to claim 4, wherein said election to make a second wager is offered only if said sixth card would also create the possibility of said third hand having a rank higher than said second hand.

6. A method according to claim 5, wherein said odds chart is varied depending on the rank of said second hand.

* * * * *